US005532119A

United States Patent [19]

Arcus et al.

[11] Patent Number: 5,532,119

[45] Date of Patent: Jul. 2, 1996

[54] HIGH-SPEED DIRECT-POSITIVE PHOTOGRAPHIC ELEMENTS UTILIZING CORE-SHELL EMULSIONS

[75] Inventors: Robert A. Arcus; Alfred P. Marchetti, both of Penfield, N.Y.

[73] Assignee: Eastman Kodak Company, Rochester, N.Y.

[21] Appl. No.: 37,066

[22] Filed: Mar. 25, 1993

[51] Int. Cl.[6] ..... G03C 1/035

[52] U.S. Cl. ..... 430/567; 430/598; 430/603; 430/604; 430/605

[58] Field of Search ..... 430/567, 598, 430/603, 604, 605

[56] References Cited

U.S. PATENT DOCUMENTS

| | | | |
|---|---|---|---|
| 3,672,901 | 3/1970 | Ohkubo et al. | 430/569 |
| 4,395,478 | 7/1983 | Hoyen | 430/605 |
| 4,617,258 | 10/1986 | Menjo et al. | 430/605 |
| 4,643,965 | 2/1987 | Kubota et al. | 430/567 |
| 4,806,462 | 2/1989 | Yamashita et al. | 430/604 |
| 4,863,845 | 9/1989 | Murai et al. | 430/605 |
| 4,937,180 | 6/1990 | Marchetti et al. | 430/567 |
| 4,945,035 | 7/1990 | Keevert et al. | 430/567 |
| 4,981,780 | 1/1991 | Inoue et al. | 430/598 |
| 4,996,137 | 2/1991 | Inoue et al. | 430/598 |
| 5,030,553 | 7/1991 | Kuwashima et al. | 430/598 |
| 5,112,732 | 5/1992 | Hayashi et al. | 430/604 |

FOREIGN PATENT DOCUMENTS 0573066 12/1993 European Pat. Off. .

OTHER PUBLICATIONS

United States Statutory Invention Registration H1294 to Tamada et al., Mar. 1, 1994.

*Primary Examiner*—Janet C. Baxter
*Attorney, Agent, or Firm*—Alfred P. Lorenzo

[57] ABSTRACT

Direct-positive photographic elements are comprised of a support and a silver halide emulsion layer containing core-shell silver halide grains comprising a chemically sensitized core and a chemically sensitized shell, wherein at least one of the core and the shell comprises a band of dopant and wherein the dopant is hexacyano ruthenium (II). Preferably, the shell of the core-shell grains is chemically sensitized with both a gold-containing chemical sensitizing agent and a sulfur-containing chemical sensitizing agent and the weight ratio of the gold-containing chemical sensitizing agent to the sulfur-containing chemical sensitizing agent is at least about two to one.

19 Claims, No Drawings

HIGH-SPEED DIRECT-POSITIVE PHOTOGRAPHIC ELEMENTS UTILIZING CORE-SHELL EMULSIONS

FIELD OF THE INVENTION

This invention relates in general to photography and in particular to direct-positive photographic elements. More specifically, this invention relates to high-speed direct-positive photographic elements containing doped core-shell silver halide grains.

BACKGROUND OF THE INVENTION

Photographic elements which produce images having an optical density directly related to the radiation received on exposure are said to be negative-working. A positive photographic image can be formed by producing a negative photographic image and then forming a second photographic image which is a negative of the first negative—that is, a positive image. A direct-positive image is understood in photography to be a positive image that is formed without first forming a negative image. Direct-positive photography is advantageous in providing a more straight-forward approach to obtaining positive photographic images.

A conventional approach to forming direct—positive images is to use photographic elements employing internal latent image-forming silver halide grains. After imagewise exposure, the silver halide grains are developed with a surface developer—that is, one which will leave the latent image sites within the silver halide grains substantially unrevealed. Simultaneously, either by uniform light exposure or by the use of a nucleating agent, the silver halide grains are subjected to development conditions that would cause fogging of a negative-working photographic element. The internal latent image-forming silver halide grains which received actinic radiation during imagewise exposure develop under these conditions at a slow rate as compared to the internal latent image-forming silver halide grains not imagewise exposed. The result is a direct-positive silver image. In color photography, the oxidized developer that is produced during silver development is used to produce a corresponding direct-positive dye image. Multi-color direct-positive photographic images have been extensively investigated in connection with image transfer photography.

Direct-positive internal latent image-forming emulsions can take the form of halide-conversion type emulsions. Such emulsions are illustrated by Knott et al U.S. Pat. No. 2,456,943 and Davey et al U.S. Pat. No. 2,592,250.

More recently the art has found it advantageous to employ core-shell emulsions as direct-positive internal latent image-forming emulsions. An early teaching of core-shell emulsions is provided by Porter et al U.S. Pat. No. 3,206,313, wherein a coarse grain monodispersed chemically sensitized emulsion is blended with a finer grain emulsion. The blended finer grains are Ostwald ripened onto the chemically sensitized larger grains. A shell is thereby formed around the coarse grains. The chemical sensitization of the coarse grains is "buried" by the shell within the resulting core-shell grains. Upon imagewise exposure, latent image sites are formed at internal sensitization sites and are therefore also internally located. The primary function of the shell structure is to prevent access of the surface developer to the internal latent image sites, thereby permitting low minimum densities.

The chemical sensitization of the core emulsion can take a variety of forms. One technique is to sensitize the core emulsion chemically at its surface with conventional sensitizers, such as sulfur and gold. Atwell et al U.S. Pat. No. 4,035,185 teaches that controlling the ratio of middle chalcogen to noble metal sensitizers employed for core sensitization can control the contrast produced by the core-shell emulsion. Another technique that can be employed is to incorporate a metal dopant, such as iridium, bismuth, or lead, in the core grains as they are formed.

The shell of the core-shell grains need not be formed by Ostwald ripening, as taught by Porter et al, but can be formed alternatively by direct precipitation onto the sensitized core grains. Evans U.S. Pat. Nos. 3,761,276, 3,850,637, and 3,923,513 teach that further increases in photographic speed can be realized if, after the core-shell grains are formed, they are surface chemically sensitized. Surface chemical sensitization is, however, limited to maintain a balance of surface and internal sensitivity favoring the formation of internal latent image sites.

Direct-positive emulsions exhibit art-recognized disadvantages as compared to negative-working emulsions. Although Evans, cited above, has been able to increase photographic speeds by properly balancing internal and surface sensitivities, direct-positive emulsions have not achieved photographic speeds equal to the faster surface latent image forming emulsions. Second, direct-positive core-shell emulsions are limited in their permissible exposure latitude. When exposure is extended, rereversal occurs. That is, in areas receiving extended exposure a negative image is produced. This is a significant limitation to in-camera use of direct-positive photographic elements, since candid photography does not always permit control of exposure conditions. For example, a very high contrast scene can lead to rereversal in some image areas.

Radiation-sensitive emulsions which are comprised of core-shell silver halide grains and are adapted to form direct-positive images are also described in detail in T. H. James, "The Theory Of The Photographic Process", Fourth Edition, Chapter 7, pages 182 to 193, MacMillan Publishing Co., (1977).

Incorporation in the aforesaid core-shell silver halide grains of certain polyvalent metal ions for the purpose of reducing rereversal is described in Hoyen, U.S. Pat. No. 4,395,478, issued Jul. 26, 1983. In particular, Hoyen discloses incorporation in the shell portion of such grains of one or more polyvalent metal ions chosen from the group consisting of manganese, copper, zinc, cadmium, lead, bismuth and lanthanides. While the use of such doping agents represents a major advance in the art by minimizing the rereversal problem, the direct-positive photographic elements described by Hoyen do not exhibit as high a level of photographic speed as is needed to satisfy current requirements, especially when the direct-positive elements are used in COM (computer output microfilm) applications.

It is toward the obective of providing improved direct-positive photographic elements with markedly enhanced speed characteristics that the present invention is directed.

SUMMARY OF THE INVENTION

In accordance with this invention, novel direct-positive photographic elements are comprised of a support and a silver halide emulsion layer containing core-shell silver halide grains comprising a chemically sensitized core and a chemically sensitized shell, at least one of the core and the shell comprising a band of dopant, characterized in that the dopant is hexacyano ruthenium (II).

The improved direct-positive photographic elements of this invention provide excellent photographic speed together with the many advantages and conveniences of a direct-positive system. While similar high speeds can be obtained by use of negative-working elements that provide reversal images via an additional dichromate bleach and a second development step in processing, the use of dichromate bleaches and additional processing solutions is undesirable from both cost and environmental standpoints. By use of the invention described herein, silver halide grain size can be kept small enough that the quality of microfilm images is not compromised yet the desired high speed can nonetheless be achieved. Attempts to obtain the desired high speed by use of relatively large size silver halide grains are not feasible since the resulting high degree of granularity is unacceptable for microfilm images.

In carrying out this invention, hexacyano ruthenium (II) is incorporated into either the core or the shell or both during precipitation of the silver halide grains by incorporating into the reactant mixture a suitable salt of hexacyano ruthenium (II), for example an alkali metal salt such as sodium hexacyano ruthenium (II) which has the formula $Na_4Ru(CN)_6$ or potassium hexacyano ruthenium (II) which has the formula $K_4Ru(CN)_6$.

The use of hexacyano ruthenium (II) as a doping agent in silver bromide emulsions to provide increased stability, both in terms of observed speed and minimum density, and to provide reductions in low intensity reciprocity failure is described in Marchetti et al, U.S. Pat. No. 4,937,180, issued Jun. 26, 1990. The use of hexacyano ruthenium (II) as a doping agent in silver chloride emulsions to provide increased sensitivity is described in Keevert et al, U.S. Pat. 4,945,035, issued Jul. 31, 1990. However, both of these patents relate to the use of doping agents in negative-working emulsions, whereas the present invention pertains to direct-positive core-shell emulsions and these function by distinctly different mechanisms.

As described in the aforesaid U.S. Pat. Nos. 4,937,180 and 4,945,035, it is believed that the entire metal complex is incorporated intact into the silver halide grains. Thus, both the ruthenium and the cyano ligands function together in this invention to provide doping which enhances photographic speed in a direct-positive system.

DESCRIPTION OF THE PREFERRED EMBODIMENTS

The doping agent utilized in this invention, namely hexacyano ruthenium (II), is typically employed in an amount of from about 10 to about 1000 ppm (parts per million) by weight based on the weight of silver in the silver halide grains. Preferred amounts are in the range of from about 25 to about 400 ppm; while particularly preferred amounts are in the range of from about 50 to about 200 ppm. The hexacyano ruthenium (II) can be present in either the core or the shell of the core-shell grains or in both the core and the shell.

The formation of core-shell emulsions according to the present invention can begin with any convenient conventional sensitized core emulsion. The core emulsion can be comprised of silver bromide, silver chloride, silver chlorobromide, silver chloroiodide, silver bromoiodide, or silver chlorobromoiodide grains. The grains can be coarse, medium, or fine and can be bounded by any crystal planes, such as 100, 111 or 110. Prior to shelling, the core grains are preferably monodisperse. That is, the core grains prior to shelling preferably exhibit a coefficient of variation of less than 20% and for very high contrast applications optimally exhibit a coefficient of variation of less than 10%. The preferred completed core-shell emulsions of this invention exhibit similar coefficients of variation. (As employed herein the coefficient of variation is defined as 100 times the standard deviation of the grain diameter divided by the average grain diameter.) Although other sensitizations of the core emulsions are possible and contemplated, it is preferred to surface chemically sensitize the core emulsion grains with a combination of middle chalcogen and noble metal sensitizers, as taught by Atwell et al, cited above. Additionally either middle chalcogen or noble metal sensitization can be employed alone. Sulfur, selenium, and gold are preferred sensitizers.

Although the sensitized core emulsion can be shelled by the Ostwald ripening technique of Porter et al, cited above, it is preferred that the silver halide forming the shell portion of the grains be precipitated directly onto the sensitized core grains by the double-jet addition technique. Double-jet precipitation is well known in the art as illustrated by *Research Disclosure,* Vol. 176, December 1978, Item 17643, Section I, here incorporated by reference. *Research Disclosure* and its predecessor, Product Licensing Index, are publications of Industrial Opportunities Ltd., Homewell, Havant, Hampshire, P09 1EF, United Kingdom. The halide content of the shell portion of the grains can take any of the forms described above with reference to the core emulsion. Shells with a high content of chloride provide advantages with respect to developability and low intensity reciprocity failure. On the other hand, the highest realized photographic speeds are generally recognized to occur with predominantly bromide grains, as taught by Evans, cited above. Thus, the specific choice of a preferred halide for the shell portion of the core-shell grains will depend upon the specific photographic application.

The silver halide forming the shell portion of the core-shell grains must be sufficient to restrict developer access to the sensitized core portion of the grains. This will vary as a function of the ability of the developer to dissolve the shell portion of the grains during development. Although shell thicknesses as low as a few cyrstal lattice planes for developers having very low silver halide solvency are taught in the art, it is preferred that the shell portion of the core-shell grains be present in a molar ratio with the core portion of the grains of about 1:4 to 8:1, as taught by Porter et al and Atwell et al. In some instances, even lower ratios such as ratios of 1:6 or less are desirable.

After precipitation of a shell portion onto the sensitized core grains to complete formation of the core-shell grains, the emulsions can be washed, if desired, to remove soluble salts. Conventional washing techniques can be employed, such as those disclosed by *Research Disclosure*, Item 17643, cited above, Section II, here incorporated by reference.

In the core-shell emulsions of this invention, both the core and the shell are chemically sensitized. To chemically sensitize the shell, any type of surface chemical sensitization known to be useful with corresponding surface latent image-forming silver halide emulsions can be employed, such as disclosed by *Research Disclosure*, Item 17643, cited above, Section III. Middle chalcogen and/or noble metal sensitizations, as described by Atwell et al, cited above, are preferred. Sulfur, selenium and gold are specifically preferred surface sensitizers.

The degree of surface chemical sensitization is limited to that which will increase the speed of the internal latent image-forming emulsion, but which will not compete with the internal sensitization sites. Thus, a balance between internal and surface sensitization is preferably maintained for maximum speed, but with the internal sensitization predominating.

It is particularly preferred, in this invention, that the shell of the core-shell grains is chemically sensitized with both a gold-containing chemical sensitizing agent and a sulfur-containing chemical sensitizing agent and that the weight ratio of the gold-containing chemical sensitizing agent to the sulfur-containing chemical sensitizing agent be at least about 2 to 1. Use of such weight ratios of gold sensitizer to sulfur sensitizer has been unexpectedly found to provide increased photographic speed with reduced granularity for a given grain size.

The use of gold compounds as chemical sensitizers is very well known in the art (see, for example, U.S. Pat. Nos. 3,297,446 and 3,503,749). Gold compounds that are especially useful as chemical sensitizers in this invention include gold chloride, gold sulfide, gold iodide, potassium chloroaurate, potassium aurothiocyanate, chloroauric acid tetrahydrate, aurous dithiosulfate, and the like. Potassium chloroaurate is particularly preferred.

Sodium thiosulfate, which is a very commonly used example of a sulfur-containing chemical sensitizing agent, is preferably used in this invention in combination with one or more of the gold-containing chemical sensitizing agents described above.

It is preferred that the core-shell silver halide grains utilized in this invention have a mean grain size in the range of from about 0.1 to about 0.6 micrometers, and more preferably in the range of from about 0.2 to about 0.5 micrometers. Methods for determining the mean grain size of silver halide grains are well known in the photographic art. They are described, for example, in T. H. James, *The Theory Of The Photographic Process*, Fourth Edition, pages 100 to 102, MacMillan Publishing Co. (1977).

The core-shell emulsions of the present invention can, if desired, be spectrally sensitized. For multicolor photographic applications, red, green, or, optionally, blue spectral sensitizing dyes can be employed, depending upon the portion of the visible spectrum the core-shell grains are intended to record. For black-and-white imaging applications spectral sensitizing is not required, although orthochromatic or panthromatic sensitization is usually preferred. Generally, any spectral sensitizing dye or dye combination known to be useful with a negative-working silver halide emulsion can be employed with the core-shell emulsions of the present invention. Illustrative spectral sensitizing dyes are those disclosed in *Research Disclosure*, item 17643, cited above, Section IV. Particularly preferred spectral sensitizing dyes are those disclosed in *Research Disclosure*, Vol. 151, November, 1976, Item 15162, here incorporated by reference. Although the emulsions can be spectrally sensitized with dyes from a variety of classes, preferred spectral sensitizing dyes are polymethine dyes, which include cyanine, merocyanine, complex cyanine and merocyanine (i.e., tri-, tetra-, and poly-nuclear cyanine and merocyanine), oxonol, hemioxonol, styryl, merostyryl, and streptocyanine dyes. Cyanine and merocyanine dyes are specifically preferred. Spectral sensitizing dyes which sensitize surface-fogged direct-positive emulsions generally desensitize both negative-working emulsions and the core-shell emulsions of this invention and therefore are not normally contemplated for use in the practice of this invention. Spectral sensitization can be undertaken at any stage of emulsion preparation heretofore known to be useful. Most commonly, spectral sensitization is undertaken in the art subsequent to the completion of chemical sensitization. However, it is specifically recognized that spectral sensitization can be undertaken alternatively concurrently with chemical sensitization or can entirely precede chemical sensitization. Sensitization can be enhanced by pAg adjustment including cycling, during chemical and/or spectral sensitzation.

The core-shell emulsions of this invention preferably incorporate a nucleating agent to promote the formation of a direct-positive image upon processing. The nucleating agent can be incorporated in the emulsion during processing, but is preferably incorporated in manufacture of the photographic element, usually prior to coating. This reduces the quantities of nucleating agent required. The quantity of nucleating agent required can also be reduced by restricting the mobility of the nucleating agent in the photographic element. Large organic substituents capable of performing, at least to some extent, a ballasting function are commonly employed. Nucleating agents which include one or more groups to promote adsorption to the surface of the silver halide grains have been found to be effective in extremely low concentrations.

The term "nucleating agent" is employed herein in its art-recognized usage to mean a fogging agent capable of permitting the selective development of internal latent image-forming silver halide grains which have not been imagewise exposed, in preference to the development of silver halide grains having an internal latent image formed by imagewise exposure.

Nucleating agents which are useful in this invention, including both aromatic hydrazides and N-substituted cycloammonium quaternary salts, are described in full detail in Hoyen, U.S. Pat. No. 4,395,478, issued Jul. 26, 1983.

Particularly preferred nucleating agents for use in this invention are compounds of the formula:

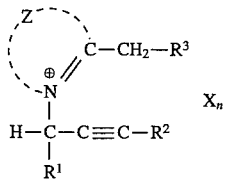

wherein

Z represents the atoms completing a heterocyclic quaternary ammonium nucleus comprised of an azolium or azinium ring;

$R^1$ is hydrogen or methyl;

$R^2$ is hydrogen or an alkyl substituent of from 1 to 8 carbon atoms;

$R^3$ is hydrogen or a substituent having a Hammett sigma value derived electron withdrawing characteristic more positive than −0.2;

X is a charge balancing counter ion; and n is 0 or 1; and

Z or $R^3$ includes a thioamido adsorption promoting moiety.

Nucleating agents of the above formula are described in Parton et al, U.S. Pat. No. 4,471,044, issued Sep. 11, 1984.

Once core-shell emulsions have been generated by precipitation procedures, washed, and sensitized, as described above, their preparation can be completed by the optional incorporation of nucleating agents, described above, and conventional photographic addenda, and they can be usefully applied to photographic applications requiring a silver image to be produced—e.g., conventional black-and-white photography.

The core-shell emulsion is comprised of a dispersing medium in which the core-shell grains are dispersed. The dispersing medium of the core-shell emulsion layers and other layers of the photographic elements can contain various colloids alone or in combination as vehicles (which include both binders and peptizers). Preferred peptizers are hydrophilic colloids, which can be employed alone or in combination with hydrophobic materials. Preferred peptizers are gelatin—e.g., alkali-treated gelatin (cattle bone or hide gelatin) and acid-treated gelatin (pigskin gelatin) and gelatin derivatives—e.g., acetylated gelatin, phthalated gelatin, and the like. Useful vehicles are illustrated by those disclosed in *Research Disclosure*, Item 17643, cited above, Section IX, here incorporated by reference. The layers of the photographic elements containing crosslinkable colloids, particularly the gelatin-containing layers, can be hardened by various organic and inorganic hardeners, as illustrated by *Research Disclosure*, Item 17643, cited above, Section X.

Instability which decreases maximum density in direct-positive emulsion coatings can be protected against by incorporation of stabilizers, antifoggants, latent image stabilizers and similar addenda in the emulsion and contiguous layers prior to coating. A variety of such addenda are disclosed in *Research Disclosure*, Item 17643, cited above Section VI.

The high-speed direct-positive photographic elements of this invention can utilize any of the support materials known for use in the photographic arts. Typical of useful polymeric film supports are films of cellulose nitrate and cellulose esters such as cellulose triacetate and diacetate, polystyrene, polyamides, homo- and co-polymers of vinyl chloride, poly-(vinylacetal), polycarbonate, homo- and co-polymers of olefins, such as polyethylene and polypropylene and polyesters of dibasic aromatic carboxylic acids with divalent alcohols, such as poly(ethylene terephthlate).

Polyester films, such as films of polyethylene terephthalate, have many advantageous properties, such as excellent strength and dimensional stability, which render them especially advantageous for use as supports in the present invention.

The invention is further illustrated by the following examples of its practice. In these examples, the mean grain size of the core-shell grains is specified in micrometers, the concentration of the doping agent hexacyano ruthenium (II) is specified in parts per million by weight based on the weight of silver in the doped core or the doped shell, as appropriate, and the concentration of nucleator is specified in millimoles per mole of total silver in the core-shell grains. Values reported in the examples for granularity are root mean square granularity values as described in T. H. James, "The Theory Of The Photographic Process", Fourth Edition, Page 619, MacMillan Publishing Co. (1977). Nucleating agents utilized in the examples are nucleator N-A which has the formula:

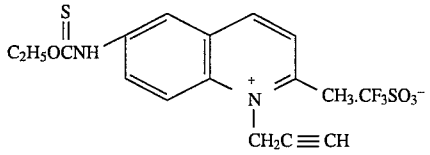

and nucleator N-B which has the formula:

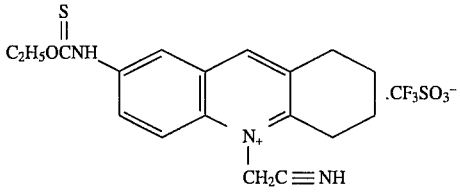

EXAMPLES 1–4

A core-shell emulsion, designated Emulsion A and employed herein as a control, was prepared in the following manner.

Precipitation of Core

A 4.5 liter aqueous solution (designated solution G) containing 70 grams of inert gelatin, 0.225 grams of a linear ethylene glycol surfactant and 3.7 grams of sodium bromide was adjusted to a pH of 2.0 at 20° C. and added to a reaction vessel. The temperature was raised to 70° C. and the pAg adjusted to 8.36 by dropwise addition from a 3.56 liter aqueous solution (designated solution R) containing 1099 grams of sodium bromide. The silver-containing solution utilized was a 1.8 liter aqueous solution (designated solution A) containing 917.3 grams of silver nitrate and 1.13 grams of nitric acid. Solutions A and R were added simultaneously with rapid stirring. The flow of solution R was adjusted so that for the first two minutes a pAg of 8.36 was maintained, with the next five minutes allowing for a transition from a pAg of 8.36 to a pAg of 7.16 which was maintained for the remaining time. A total of 92.5 weight percent of solution A was added. The remainder of Solution R was set aside for subsequent use. The resulting product was a cubic silver bromide core emulsion with a mean grain size of 0.23 micrometers.

Core Sensitization

A 1.5 liter aqueous solution (designated solution L) containing 130 grams of inert gelatin was added while maintaining the rapidly stirred emulsion at 40° C. and solution R was added dropwise so as to adjust the pAg to 8.25. To provide chemical sensitization, 15 mg of sodium thiosulfate pentahydrate and 12 mg of potassium chloroaurate were added in a sequential manner and the chemical sensitization reaction was carried out by raising the temperature to 70° C. for 30 minutes.

Shell Precipitation

The chemically-sensitized core emulsion was shelled by simultaneous addition of the remainder of solution R and a 1.8 liter aqueous solution (designated solution B) containing 917.3 grams of silver nitrate with rapid stirring at 70° C. over a period of 26.8 minutes. The resulting core-shell emulsion had a mean grain size of 0.290 micrometers. The core-shell emulsion was washed of excess salts and a 1.5 liter aqueous solution (designated solution M) containing 200 grams of inert gelatin was added.

Shell Sensitization

Shell sensitization of the core-shell emulsion was carried out by sequential addition of 2.8 mg of sodium thiosulfate pentahydrate and 5.6 milligrams of potassium chloroaurate per silver mole. The chemical sensitization reaction was carried out by raising the temperature to 70° C. for 30 minutes.

A core-shell emulsion, designated Emulsion A' and employed herein as a control, was prepared in the same manner as control Emulsion A except that 1,8-dihydroxy-3,6-dithiaoctane, a silver halide ripener, was added during core precipitation in an amount such that the mean grain size of the core-shell emulsion grains was 0.393 micrometers as compared with 0.290 micrometers for control Emulsion A.

A core-shell emulsion, designated Emulsion A" and employed herein as a control, was prepared in the same manner as Control Emulsion A except that 1,8-dihydroxy-3,6-dithiaoctane was added during core precipitation in an amount such that the mean grain size of the core-shell emulsion grains was 0.423 micrometers as compared with 0.290 micrometers for control Emulsion A.

In the core-shell emulsions made with ripener, the amount of core chemical sensitization was adjusted downward by multiplying the sulfur and gold sensitizer values described above by the ratio 0.23/ECD (effective circular diameter) of the ripened core emulsion. Likewise, the chemical sensitizer levels for the shell were adjusted downward by multiplying the values described above by the ratio 0.29/ECD of the ripened emulsion.

A core-shell emulsion, designated emulsion B and having the dopant hexacyano ruthenium (II) incorporated in the shell, was prepared in the same manner as emulsion A' except that a 1.45 liter aqueous solution (designated solution S) containing 14.88 grams of sodium bromide and 0.1084 grams of potassium hexacyano ruthenium (II) was added at a constant flow rate starting 2.87 minutes after the beginning of shell precipitation and stopping 4.85 minutes before the completion of shell precipitation.

A core-shell emulsion, designated emulsion B' and having the dopant hexacyano ruthenium (II) incorporated in the shell was prepared in the same manner as emulsion A" except that solution S was added at a constant flow rate starting 2.87 minutes after the beginning of shell precipitation and stopping 4.85 minutes before the completion of shell precipitation.

A core-shell emulsion, designated emulsion C and having the dopant hexacyano ruthenium (II) incorporated in the core, was prepared in the same manner as emulsion A except that a 1.59 liter aqueous solution (designated solution T) containing 14.88 grams of sodium bromide and 0.119 grams of potassium hexacyano ruthenium (II) was added at a constant flow rate starting 3.00 minutes after the beginning of core precipitation and stopping 4.932 minutes before the completion of core precipitation.

A core-shell emulsion designated emulsion C' and having the dopant hexacyano ruthenium (II) incorporated in the core, was prepared in the same manner as emulsion A" except that solution T was added at a constant flow rate starting 3.00 minutes after the beginning of core precipitation and stopping 4.932 minutes before the completion of core precipitation.

Each of emulsions A, A', A", B, B', C and C' was coated on 7-mil cellulose acetate support to produce a test film. The melt containing the silver halide emulsion was coated at 69.9 grams of 40° C. melt per square meter. Prior to coating, a sensitizing dye, additional inert gelatin and a nucleator were added to the melt The sensitizing dye employed (designated dye S-1) was a triethylamine complex of naphtho(1,2-d)thiazolium- 1-(3-sulfopropyl)-2-[(3-sulfopropyl)-2(3H)-benzothiazolylidene]methylhydroxide inner salt. The nucleator employed was nucleator N-A. The pH and pAg values of the melts were 5.6 and 8.0, respectively. The coverage of inert gelatin in the emulsion layer was 2.69 grams per square meter. A gelatin overcoat hardened with 2.1 weight percent of the hardener 1,1'-methylenebis(sulfonyl)-bis-ethene was applied at a gelatin coverage of 0.915 grams per square meter.

The test films were exposed with a Xenon flash sensitometer at 1/14000 of a second through a filter pack (See David A. Cree, "Sensitometric Simulation Of The Spectral Emission Of Standard Phosphors", *PHOTOGRAPHIC SCIENCE AND ENGINEERING*, Vol. 13, No. 1, p. 18–23, 1969.) that simulates the exposure from a P22B phosphor of a cathode ray tube employed in typical COM devices for microfilm. A step tablet with twenty individually calibrated densities was used to impose an exposure range on the test film strip. The photographic visual densities of the processed film strips were plotted versus the log of the known exposure intensities to obtain the characteristic density versus log exposure curve. From each characteristic curve, the minimum density, $D_{min}$, the maximum density, $D_{max}$, and the toe speed at a point 0.1 density units above $D_{min}$ was calculated. The speeds are reported as delta speeds, that is speed increases above that of the control emulsion.

All of the test films were processed with EASTMAN KODAK MX-1330 developer at 93° C. in a modified KODAK PROSTAR PROCESSOR that gave 30 second development time and 30 second fix and wash times.

The emulsion characteristics and photographic parameters are summarized in Table I below.

TABLE I

| Example No. | Emulsion | Mean Grain Size (micrometers) | Dopant Level (PPM) | Location of Dopant | Nucleator Concentration (millimoles/mole Ag) | $D_{min}$ | $D_{max}$ | Delta Toe Speed |
|---|---|---|---|---|---|---|---|---|
| Control 1 | A | 0.290 | 0 | — | 0.022 | 0.032 | 2.26 | 0 |
| Control 2 | A' | 0.393 | 0 | — | 0.011 | 0.082 | 2.39 | 0 |
| Control 3 | A" | 0.423 | 0 | — | 0.011 | 0.098 | 2.27 | 0 |
| Example 1 | B | 0.391 | 100 | Shell | 0.0055 | 0.039 | 2.25 | 22 |
| Example 2 | B' | 0.424 | 100 | Shell | 0.011 | 0.054 | 2.20 | 22 |
| Example 3 | C | 0.286 | 60 | Core | 0.022 | 0.049 | 2.20 | 18 |
| Example 4 | C' | 0.424 | 60 | Core | 0.011 | 0.066 | 1.94 | 29 |

As shown by the data in Table I, incorporation of the dopant hexacyano ruthenium (II) in either the core or the shell provided a significant improvement in photographic speed as compared to an undoped emulsion of similar grain size while also giving comparable $D_{min}$ and $D_{max}$ values. Thus, Example 1 and Control 2 have similar grain sizes but Example 1 exhibits a delta toe speed of 22 due to the presence of the dopant in the shell. Similar results are seen in comparing Example 2 and Control 3, in comparing Example 3 and Control 1, and in comparing Example 4 and Control 3.

EXAMPLES 5–13

Emulsions D, E, F and G, similar to Emulsion C', were prepared except that the amounts of sulfur and gold sensitizers employed were varied. In each of emulsions D, E, F and G, the mean grain size was 0.416 micrometers, hexacyano ruthenium (II) was incorporated in the core in an amount of 60 ppm, and the amount of nucleator N-A was 0.011 millimoles per Ag mole.

Emulsions H, I, J, K and L, similar to Emulsion B, were prepared except that the amounts of sulfur and gold sensitizers employed were varied. In each of emulsions H, I, J, K and L, the mean grain size was 0.396 micrometers, hexacyano ruthenium (II) was incorporated in the shell in an amount of 100 ppm, and the amount of nucleator N-A was 0.022 millimoles per Ag mole.

The levels of sulfur (sodium thiosulfate pentahydrate) and gold (potassium chloroaurate) sensitization and the photographic parameters are summarized in Table II.

TABLE II

| Example No. | Emulsion | Sulfur (mg/mole Ag) | Gold (mg/mole Ag) | Weight Ratio of Gold to Sulfur | $D_{min}$ | $D_{max}$ | Toe Speed | Granularity |
|---|---|---|---|---|---|---|---|---|
| 5 | D | 6.0 | 2.0 | 0.33 | 0.037 | 2.40 | 180.2 | 12.9 |
| 6 | E | 4.0 | 2.0 | 0.50 | 0.040 | 2.39 | 181.7 | 13.3 |
| 7 | F | 2.0 | 2.0 | 1 | 0.037 | 2.23 | 189.0 | 12.6 |
| 8 | G | 2.0 | 4.0 | 2 | 0.057 | 2.16 | 192.5 | 12.4 |
| 9 | H | 4.0 | 4.0 | 1 | 0.08 | 2.78 | 233 | 11.43 |
| 10 | I | 2.0 | 4.0 | 2 | 0.07 | 2.42 | 254 | 11.4 |
| 11 | J | 3.0 | 6.0 | 2 | 0.11 | 2.49 | 254 | 10.18 |
| 12 | K | 2.0 | 8.0 | 4 | 0.12 | 2.46 | 247 | 10.83 |
| 13 | L | 2.0 | 12.0 | 6 | 1.08 | 2.40 | 243 | 11.22 |

As shown by the data in Table II, at a given grain size the weight ratio of gold sensitizer to sulfur sensitizer affects both speed and granularity. At an optimum ratio, increased speed and reduced granularity are achieved, while still maintaining acceptable $D_{max}$ and $D_{min}$ values.

EXAMPLES 14–18

Emulsions M, N, O, P and Q, similar to Control Emulsion A were prepared except that the amount of nucleator N-A was varied. In each of emulsions M, N, O, P and Q, the mean grain size was 0.290 micrometers, no dopant was employed, the sulfur sensitizer level was 2.0 mg/mole Ag and the gold sensitizer level was 4.0 mg/mole Ag.

Emulsions R, S, T, U and V, similar to Emulsion B, were also prepared except that the amount of nucleator N-A was varied. In each of emulsions R, S, T, U and V, the mean grain size was 0.396 micrometers, hexacyano ruthenium (II) was incorporated in the shell in an amount of 100 ppm, the sulfur sensitizer level was 2.0 mg/mole Ag and the gold sensitizer level was 4.0 mg/mole Ag.

The concentrations of nucleator employed and the photographic parameters are summarized in Table III.

TABLE III

| Example No. | Emulsion | Nucleator Level (mg/mole Ag) | $D_{min}$ | $D_{max}$ | Toe Speed | Granularity |
|---|---|---|---|---|---|---|
| Control 4 | M | 0.0660 | 0.21 | 2.59 | 186 | 10.89 |
| Control 5 | N | 0.0311 | 0.16 | 2.21 | 243 | 10.26 |
| Control 6 | O | 0.0220 | 0.15 | 2.16 | 259 | 11.96 |
| Control 7 | P | 0.0156 | 0.14 | 1.99 | 260 | 9.05 |
| Control 8 | Q | 0.0110 | 0.12 | 1.04 | 266 | 14.91 |
| 14 | R | 0.0440 | 0.12 | 2.45 | 236 | 10.93 |
| 15 | S | 0.0220 | 0.07 | 2.42 | 254 | 11.40 |
| 16 | T | 0.0110 | 0.06 | 2.50 | 260 | 10.85 |
| 17 | U | 0.0078 | 0.05 | 2.51 | 258 | 11.02 |
| 18 | V | 0.0055 | 0.04 | 2.40 | 260 | 12.09 |

As shown by the data in Table III, the photographic speed and $D_{max}$ of the undoped control emulsions varied much more drastically with change in nucleator level than did the photographic speed and $D_{max}$ of the doped emulsions prepared in accordance with this invention. Thus, exact control of nucleator concentration is much less critical with the doped emulsions.

EXAMPLES 19–25

Emulsions (a), (b), (c), (d), (e), (f) and (g), similar to emulsion B, were prepared to compare the performance of nucleator N-A with the performance of nucleator N-B. In each of emulsions (a), (b), (c), (d), (e), (f) and (g), the mean grain size was 0.424 micrometers, hexacyano ruthenium (II) was incorporated in the shell in an amount of 100 ppm, the sulfur sensitizer level was 2.0 mg/mole Ag and the gold sensitizer level was 4.0 mg/mole Ag.

The concentrations of nucleator employed and the photographic parameters are summarized in Table IV.

TABLE IV

| Example No. | Emulsion | Nucleator Employed | Nucleator Level (mg/Ag mole) | $D_{min}$ | $D_{max}$ | Toe Speed | Granularity |
|---|---|---|---|---|---|---|---|
| 19 | (a) | N-B | 0.022 | 0.395 | 1.83 | 105 | 13.68 |

TABLE IV-continued

| Example No. | Emulsion | Nucleator Employed | Nucleator Level (mg/Ag mole) | $D_{min}$ | $D_{max}$ | Toe Speed | Granularity |
|---|---|---|---|---|---|---|---|
| 20 | (b) | N-B | 0.011 | 0.289 | 1.69 | 127 | 13.46 |
| 21 | (c) | N-B | 0.0055 | 0.167 | 1.51 | 175.6 | — |
| 22 | (d) | N-B | 0.0022 | 0.081 | 1.62 | 200 | 13.50 |
| 23 | (e) | N-B | 0.0011 | 0.050 | 1.74 | 196.4 | 14.18 |
| 24 | (f) | N-B | 0.00055 | 0.032 | 1.77 | 199.2 | 15.08 |
| 25 | (g) | N-A | 0.011 | 0.063 | 2.02 | 193.3 | 13.85 |

As shown by the data in Table IV, nucleator N-A provides a significantly better $D_{max}$ at comparable speed than does nucleator N-B.

Considering the data in all of the examples above, it is apparent that hexacyano ruthenium (II) is a remarkably effective doping agent for direct-positive core-shell emulsions. It provides excellent photographic speed while permitting the use of silver halide grains of sufficiently small size that the developed granularity level is fully acceptable for COM applications. It also gives fully acceptable values for $D_{min}$ and $D_{max}$.

The invention has been described in detail, with particular reference to certain preferred embodiments thereof, but it should be understood that variations and modifications can be effected within the spirit and scope of the invention.

What is claimed is:

1. A direct-positive photographic element comprising a support and a silver halide emulsion layer containing core-shell silver halide grains comprising a chemically sensitized core and a chemically sensitized shell, at least one of said core and said shell comprising a band of dopant, characterized in that said dopant is hexacyano ruthenium (II).

2. A direct-positive photographic element as claimed in claim 1, wherein said hexacyano ruthenium (II) is present only in said core.

3. A direct-positive photographic element as claimed in claim 1, wherein said hexacyano ruthenium (II) is present only in said shell.

4. A direct-positive photographic element as claimed in claim 1, wherein said hexacyano ruthenium (II) is present in both said core and said shell.

5. A direct-positive photographic element as claimed in claim 1, wherein said hexacyano ruthenium (II) is present in said core-shell silver halide grains in an amount of from about 10 to about 1000 parts per million by weight based on the weight of silver in said core-shell silver halide grains.

6. A direct-positive photographic element as claimed in claim 1, wherein said hexacyano ruthenium (II) is present in said core-shell silver halide grains in an amount of from about 25 to about 400 parts per million by weight based on the weight of silver in said core-shell silver halide grains.

7. A direct-positive photographic element as claimed in claim 1, wherein said hexacyano ruthenium (II) is present in said core-shell silver halide grains in an amount of from about 50 to about 200 parts per million by weight based on the weight of silver in said core-shell silver halide grains.

8. A direct-positive photographic element as claimed in claim 1, wherein said core is chemically sensitized with both a gold-containing chemical sensitizing agent and a sulfur-containing chemical sensitizing agent.

9. A direct-positive photographic element as claimed in claim 1, wherein said shell is chemically sensitized with both a gold-containing chemical sensitizing agent and a sulfur-containing chemical sensitizing agent.

10. A direct-positive photographic element as claimed in claim 1, wherein both said core and said shell are chemically sensitized with both a gold-containing chemical sensitizing agent and a sulfur-containing chemical sensitizing agent.

11. A direct-positive photographic element as claimed in claim 1, wherein said shell is chemically sensitized with both a gold-containing chemical sensitizing agent and a sulfur-containing chemical sensitizing agent and the weight ratio of said gold-containing chemical sensitizing agent to said sulfur-containing chemical sensitizing agent is at least about 2 to 1.

12. A direct-positive photographic element as claimed in claim 1, wherein said shell is chemically sensitized with a combination of potassium chloroaurate and sodium thiosulfate.

13. A direct-positive photographic element as claimed in claim 1, wherein said element is spectrally sensitized with a cyanine or merocyanine spectral sensitizing dye.

14. A direct-positive photographic element as claimed in claim 1, wherein said core-shell silver halide grains have a mean grain size in the range of from about 0.1 to about 0.6 micrometers.

15. A direct-positive photographic element as claimed in claim 1, wherein said core-shell silver halide grains have a mean grain size in the range of from about 0.2 to about 0.5 micrometers.

16. A direct-positive photographic element as claimed in claim 1, wherein said silver halide emulsion layer comprises an aromatic hydrazide nucleating agent.

17. A direct-positive photographic element as claimed in claim 1, wherein said silver halide emulsion layer comprises, as a nucleating agent, an N-substituted cycloammonium quaternary salt.

18. A direct-positive photographic element as claimed in claim 1, wherein said silver halide emulsion layer comprises a nucleating agent of the formula:

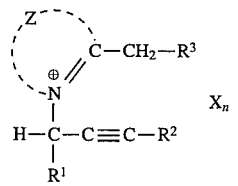

wherein z represents the atoms completing a heterocyclic quaternary ammonium nucleus comprised of an azolium or azinium ring;

$R^1$ is hydrogen or methyl;

$R^2$ is hydrogen or an alkyl substituent of from 1 to 8 carbon atoms;

$R^3$ is hydrogen or a substituent having a Hammett sigma value derived electron withdrawing characteristic more positive than −0.2;

X is a charge balancing counter ion; and
n is 0 or 1; and
Z or $R^3$ includes a thioamido adsorption promoting moiety.
19. A direct-positive photographic element as claimed in claim 1, wherein said silver halide emulsion layer comprises a nucleating agent of the formula:
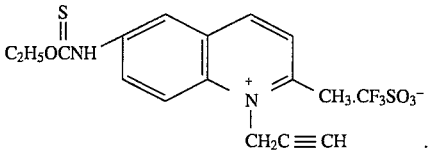
* * * * *